US006524198B2

(12) United States Patent
Takeda

(10) Patent No.: US 6,524,198 B2
(45) Date of Patent: Feb. 25, 2003

(54) GOLF CLUB AND METHOD OF MANUFACTURING THE SAME

(75) Inventor: Hitoshi Takeda, Tsubame (JP)

(73) Assignee: K.K. Endo Seisakusho (JP)

( * ) Notice: Subject to any disclaimer, the term of this patent is extended or adjusted under 35 U.S.C. 154(b) by 0 days.

(21) Appl. No.: 09/858,140

(22) Filed: May 15, 2001

(65) Prior Publication Data

US 2002/0004428 A1 Jan. 10, 2002

(30) Foreign Application Priority Data

Jul. 7, 2000 (JP) ..... 2000-207472

(51) Int. Cl.[7] ..... A63B 53/04
(52) U.S. Cl. ..... 473/338; 473/345
(58) Field of Search ..... 473/324, 329, 473/342, 345, 346, 349, 350, 333, 334, 335, 336, 337, 338, 339, 409

(56) References Cited

U.S. PATENT DOCUMENTS 2,163,091 A * 6/1939 Held
4,214,754 A * 7/1980 Zebelean
4,429,879 A * 2/1984 Schmidt
4,438,931 A * 3/1984 Motomiya
4,465,221 A * 8/1984 Schmidt
5,294,037 A * 3/1994 Schmidt
5,346,216 A * 9/1994 Aizawa
5,465,968 A * 11/1995 Aizawa
5,669,825 A * 9/1997 Shira
5,697,855 A * 12/1997 Aizawa
6,089,992 A * 7/2000 Onuki
6,162,133 A * 12/2000 Peterson
6,203,448 B1 * 3/2001 Yamamoto
6,206,789 B1 * 3/2001 Takeda
6,238,300 B1 * 5/2001 Igarashi
6,299,549 B1 * 10/2001 Shieh
6,350,209 B1 * 2/2002 Chen

* cited by examiner

*Primary Examiner*—Sebastiano Passaniti
(74) *Attorney, Agent, or Firm*—Akerman Senterfitt

(57) ABSTRACT

A golf club which has a sufficient strength, with a good appearance. A head 1 is formed by joining a face shell member 4, a sole and peripheral-side shell member 7, a crown shell member 8 and a balance weight member 9, one another. A clearance L between the sole 7 of the sole and peripheral-side shell member 7 and the balance weight member 9 is filled with a mixture 13 of gluing agent and metallic powder. Thus, the clearance L is fully filled, thereby improving an appearance of the head 1. As the mixture 13 includes metallic powder, the mixture 13 that fills the clearance L is also reinforced. As the gluing agent is an adhesive, the mixture 13 is bonded to the clearance L simply by filling the clearance L with the same, thus easily filling the clearance L.

4 Claims, 6 Drawing Sheets

GOLF CLUB AND METHOD OF MANUFACTURING THE SAME

BACKGROUND OF THE INVENTION a) Field of the Invention

The present invention relates to a golf club, comprising a metallic head constructed by combining plural members, having a shaft connected therewith, and a method of manufacturing the same.

b) Prior Art

Conventionally, the degree of freedom in design of a golf club head, such as the setting of the center of gravity of a club head, has been enhanced by combining a plurality of members. Particularly, combining two or more different metals would add high efficiency to a head. To join such plural members, various means such as welding, caulking and screw fastening have been used.

Joining by means of welding, however, would cause pinholes to produce clearances, while joining by means of caulking or screwing would produce a clearance between adjacent joined members, thus impairing appearance. It is very difficult to prevent the producing of such clearances, because it is impossible in mass production to reduce the dimensional tolerance of respective members to zero, and the members are, if subjected to plastic processing, yet hard to satisfactorily deform, and hard to apply high pressure thereto due to their unique configurations. For these reasons, clearances due to pinholes would be mended by welding, clearances due to caulking would be hammered to either forcefully press the irregularities to the inside or subject the same to plastic deformation to fill the clearances. On the other hand, clearances due to screw fastening can be minimized, by improving the dimensional accuracy of respective members, to which, however, there is a limit in mass production.

SUMMARY OF THE INVENTION

Accordingly, it is a main object of the present invention to provide a golf club with sufficient strength and good appearance.

It is another object of the present invention to provide a method of manufacturing a golf club which has sufficient strength and good appearance.

To attain the above objects, there is provided, in accordance with an embodiment of the invention, a golf club, comprising a metallic head with a shaft connected thereto, wherein said metallic head is constructed by combining a plurality of members, wherein a clearance between the members is filled with a mixture of gluing agent and metallic powder.

Thus, it is possible to easily fill up the clearance by simply filing the same with the mixture.

According to another embodiment of the invention, there is provided a method of manufacturing a golf club, comprising a metallic head with a shaft connected thereto, said metallic head being constructed by combining a plurality of members, said method comprising the steps of: joining said members together; and then filling a clearance between the members with a mixture of gluing agent and metallic powder.

Accordingly, it is possible to provide a method of manufacturing a golf club whose clearance between the joined members can be easily filled up by simply filing the same with the mixture.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 1 is a section of a golf club according to a first embodiment of the invention, while FIG. 2 is a bottom view showing a golf club according to the first embodiment of the invention, while

FIG. 4 is a section of a golf club according to a second embodiment of the invention, while

FIG. 5 is a section of a golf club according to a third embodiment of the invention, while

FIG. 6 is a front view showing a golf club according to the third embodiment of the invention, while

DESCRIPTION OF PREFERRED EMBODIMENTS

Hereinafter will be described embodiments of the invention with reference to the attached drawings.

Figure 1:
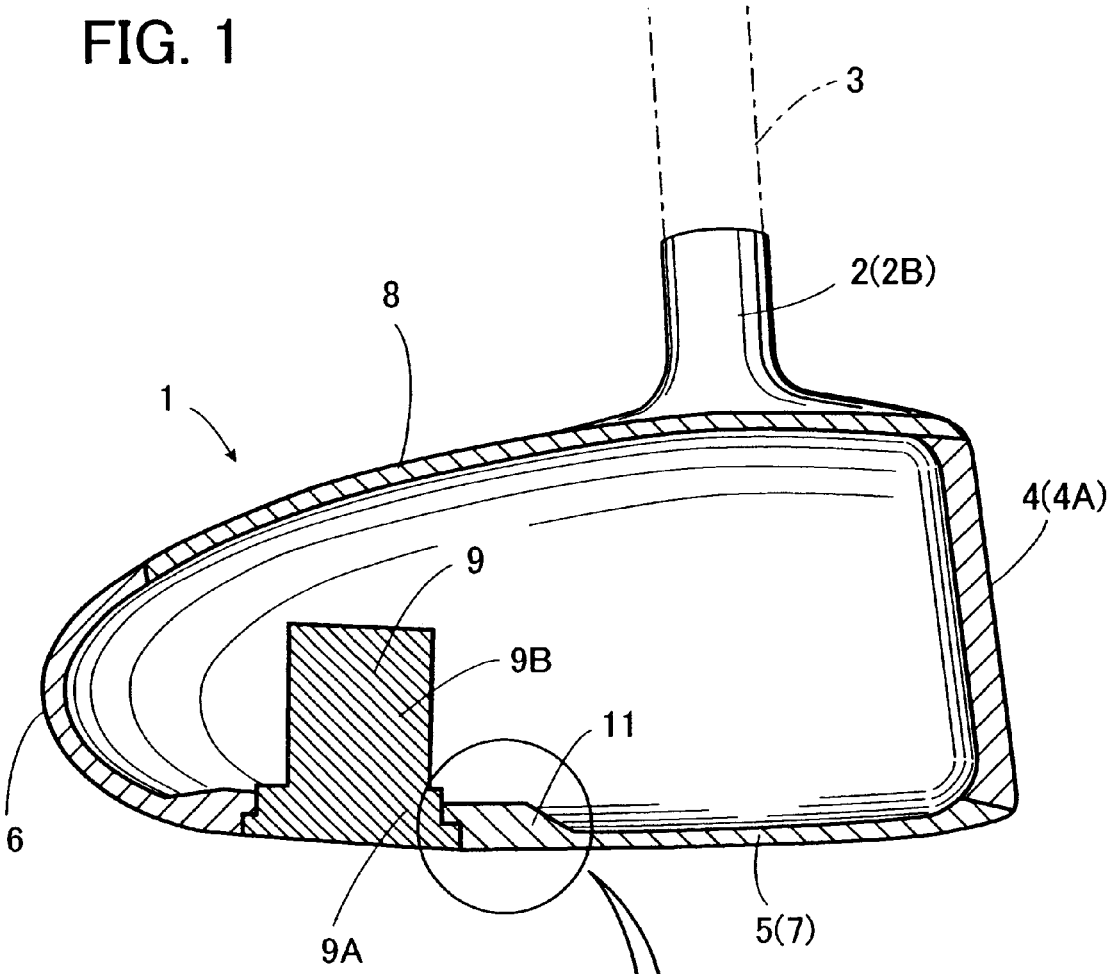
Figure 1A:
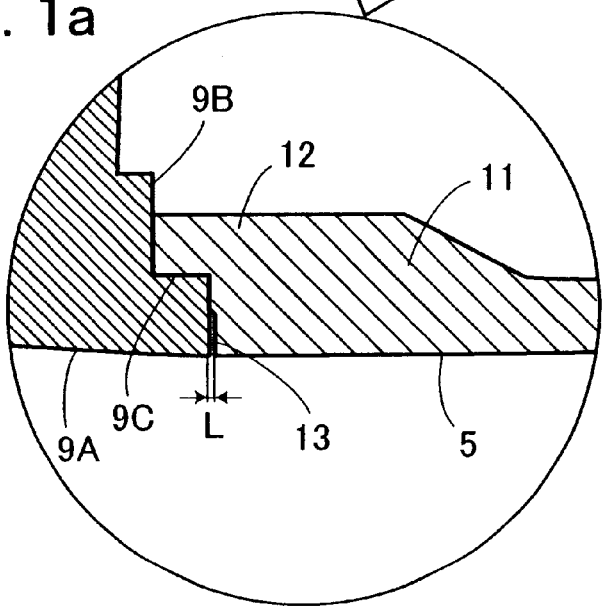
FIG. 1*a* is a partly enlarged section thereof
Figure 2:
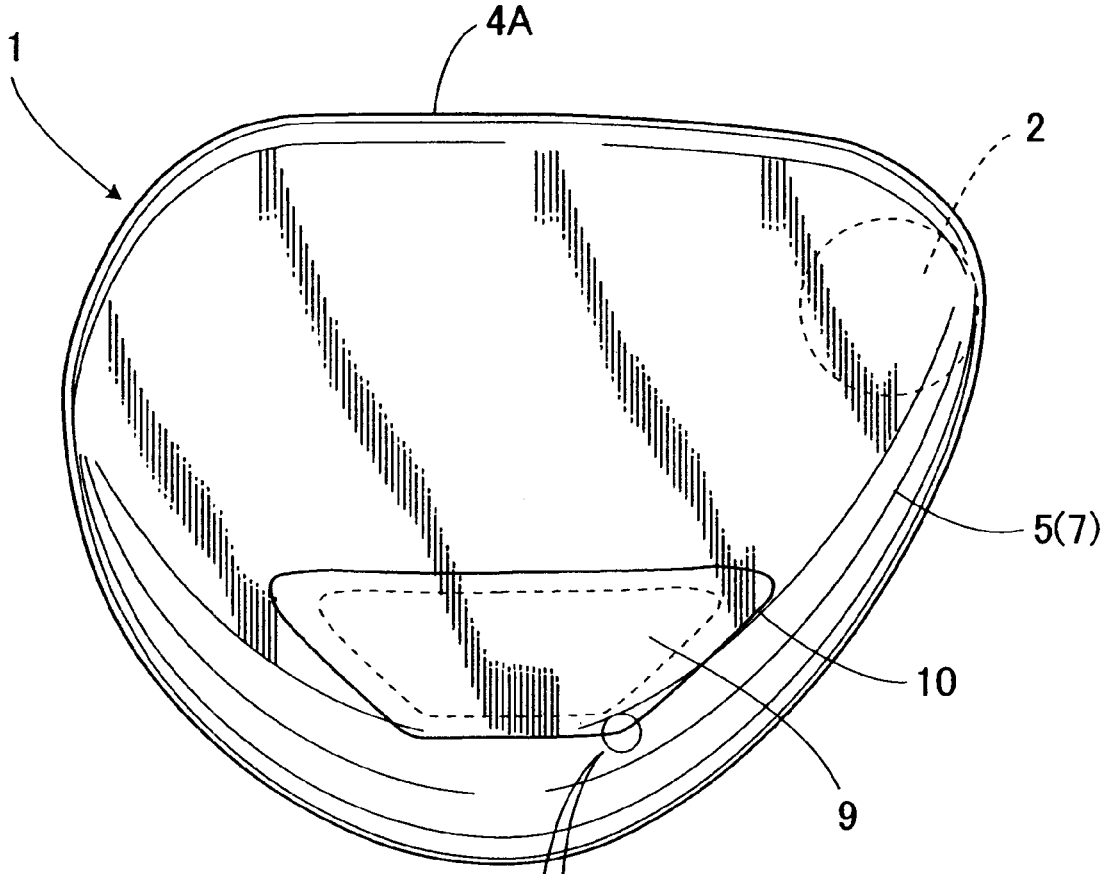
Figure 2A:
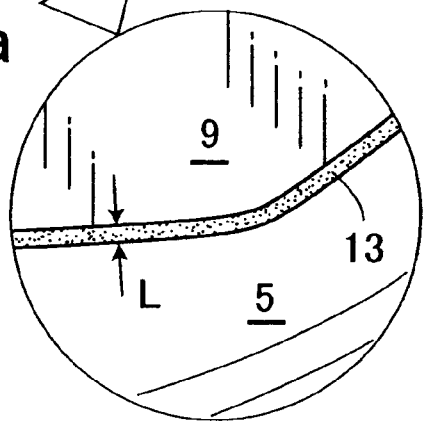
FIG. 2*a* is a partly enlarged view thereof.
Figure 3:
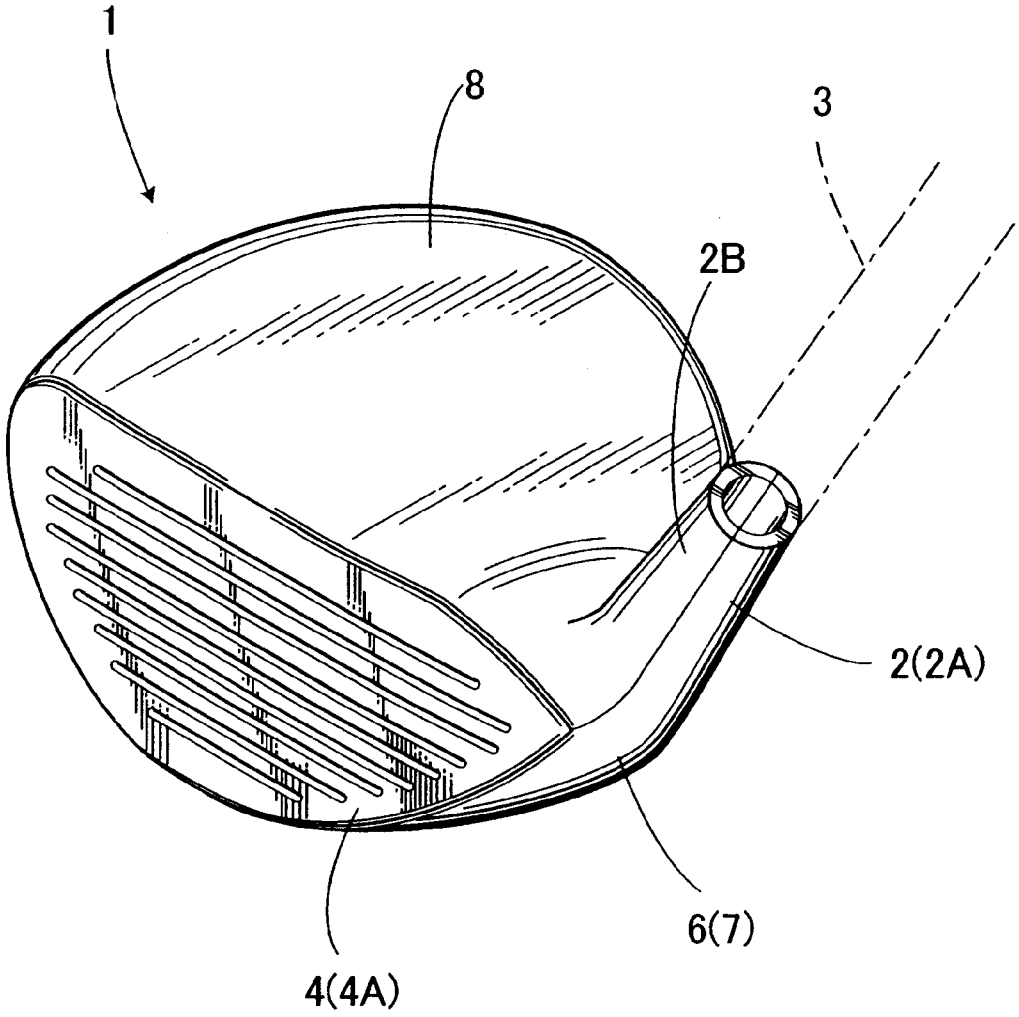
FIG. 3 is a perspective view showing the first embodiment of the invention.

Referring to FIGS. 1 through 3 showing a first embodiment of the invention, a metal wood golf club of the invention is constructed of a golf club head 1 having a hosel 2, and a shaft 3 connected to the hosel 2. The head 1 is constructed by joining together a face shell member 4 with a face 4A formed thereon, a sole and peripheral-side shell member 7 with a sole 5 and peripheral side portion 6 formed thereon, and a crown shell member 8, each shell member being made from either titanium or titanium alloy, and joined together by welding. Said hosel 2 has a first side 2A formed integrally with said sole and peripheral-side shell member 7, while the hosel 2 has a second side 2B formed integrally with the crown shell member 8.

Inside the sole 5 is provided a balance weight member 9 for enlarging a sweet area on the face by shifting the center of gravity of the head 1 backwards. The balance weight member 9 is made from a denser material than that of each shell member 4, 7, and 8, such as beryllium copper alloy. The balance weight member 9 comprises a widened lower portion 9A and a narrowed upper portion 9B formed thereon, with the lower portion 9A having a bottom face exposed to the external, which is flush with an opening 10 defined through the sole 5. The opening 10 has an edge 11 rising upward, thus caulking the balance weight member 9, while the edge 11 has an upper end 12 anchored by a stepped portion 9C provided between the lower portion 9A and the upper portion 9B. At that time, a slight clearance L is formed between the outer peripheral surface of the lower portion 9A of the balance weight member 9 and the inner peripheral surface of the edge 11, and thus appearance is impaired. Therefore, into the clearance L is injected a mixture 13 of gluing agent and metallic powder to fill the same therewith, thereby mending the impaired appearance. For such gluing agent, acrylic or epoxy-based resin adhesive is a preferred adhesive. For metallic powder, a material whose quality is similar to that of the balance weight 9, i.e., beryllium copper alloy or any other metallic material which has as similar quality and color to those of the joined metallic members as possible, is desirable. For example, copper-based metal, such as brass would be preferred, but gold dust also may be used, due to its similar color. It should be noted that the smaller the particle in the metallic powder is, the better result you can obtain. For example, the dimension thereof may be 20 μm or below, preferably 10 μm or below, most preferably 5 μm or below.

The above-mentioned gluing agent and metallic powder are mixed in proportions of one part by volume of the gluing agent per two parts by volume of metallic powder, thus producing the mixture 13. After the mixture 13 is filled in the clearance L, any surplus amount thereof can be removed easily, by wiping up the same with organic solvent, thereby improving appearance.

According to the foregoing embodiment of the inventions there is provided a golf club, comprising a metallic head 1 with a shaft connected thereto, said metallic head 1 being constructed by combining a face shell member 4, a sole and peripheral-side shell member 7, a crown shell member 8 and a balance weight member 9, wherein a mixture 13 of gluing agent and metallic powder is filled in a clearance L between the sole part of the said sole and peripheral-side shell member 7 and the balance weight member 9, thereby improving the appearance of the metallic head 1. Besides, as the mixture 13 includes metallic powder, the mixture 13 that filled in the clearance L is also reinforced, thus contributing to the reinforcing of the head 1. Furthermore, as the gluing agent is an adhesive, the mixture 13 can be easily bonded to the clearance L by simply filling the clearance L therewith.

Figure 4:
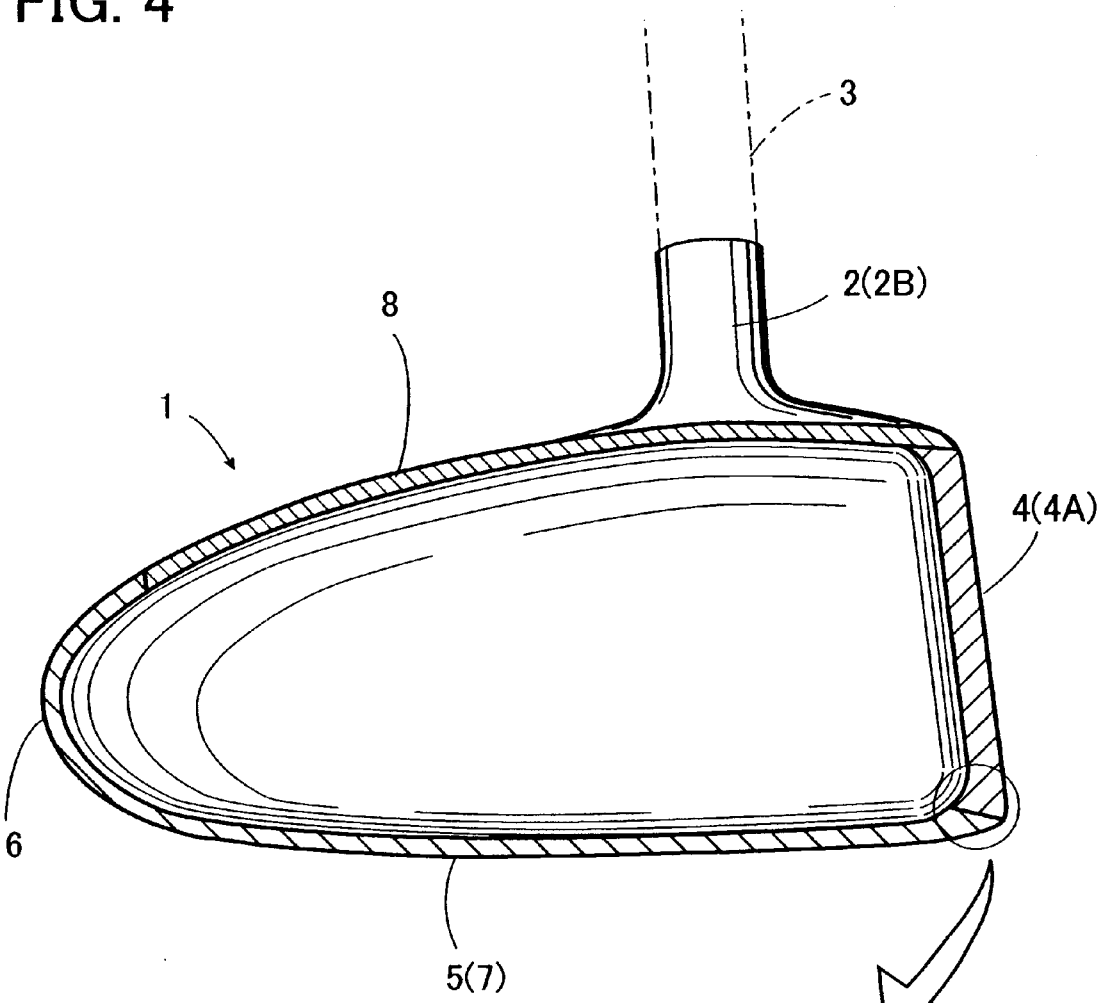
Figure 4A:
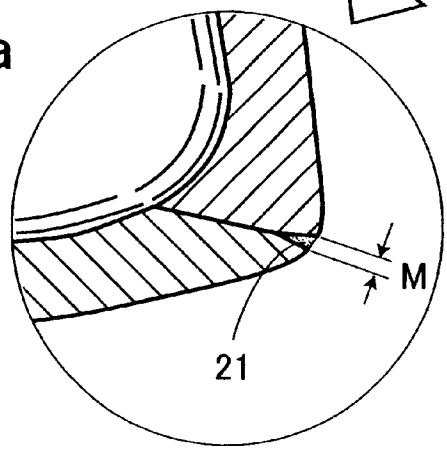
FIG. 4*a* is a partly enlarged section thereof.

In FIG. 4 showing a second embodiment of the invention, the same portions as those described in the foregoing embodiment will be designated by the same reference numerals, and their repeated descriptions will be omitted.

In the second embodiment, the head 1 comprises the face shell member 4 with the face 4A, the sole and peripheral-side shell member 7 with the sole 5 and the peripheral-side portion 6, and the crown member 8, said members being joined to one another, by welding, wherein a mixture 21 of gluing agent and metallic powder is filled in a clearance M or pinhole caused by the welding.

According to the second embodiment of the invention, as the mixture 21 of the gluing agent and the metallic powder is filled in the clearance M, the appearance of the head is improved. Further, as the mixture 21 includes metallic powder, the mixture 21 for filling into the clearance M is also reinforced, which in turn means that the strength of the head 1 also is improved. In addition, as the gluing agent is an adhesive, the clearance M can be filled in easily.

Figure 5:
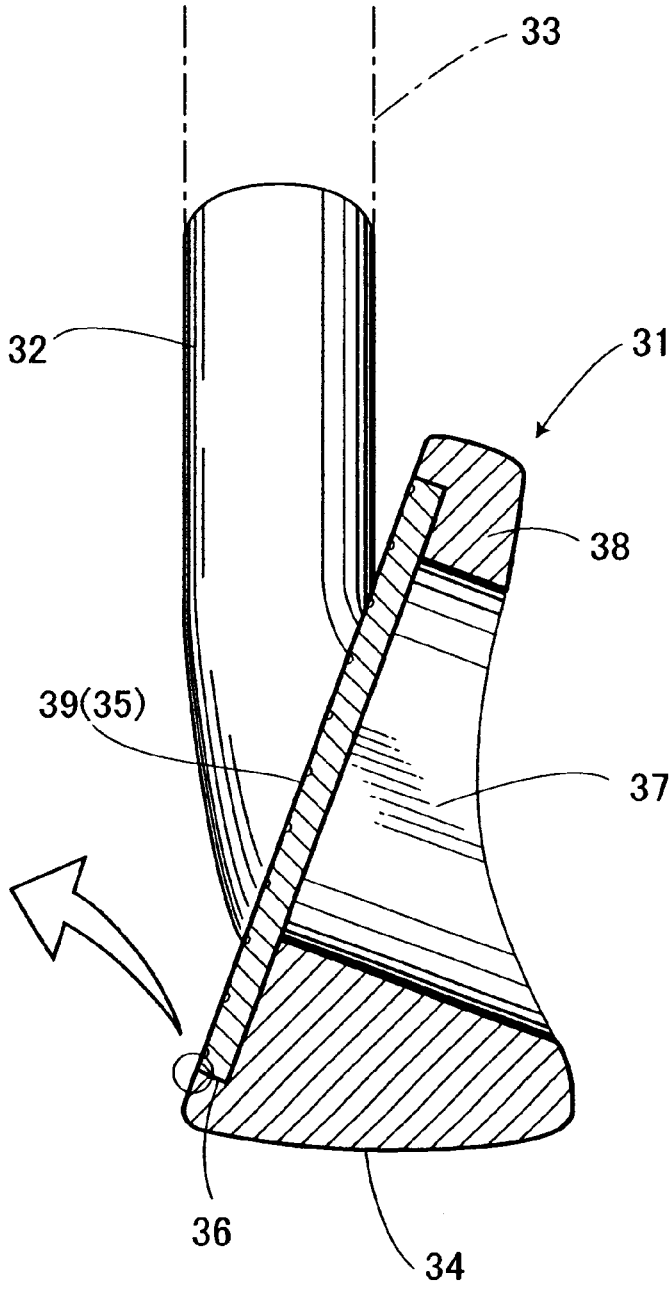
Figure 5A:
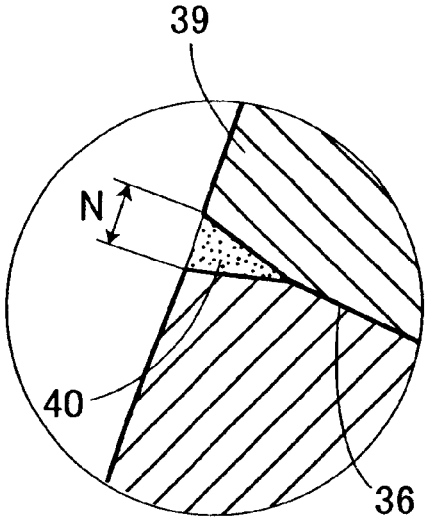
FIG. 5*a* is a partly enlarged section thereof.
Figure 6:
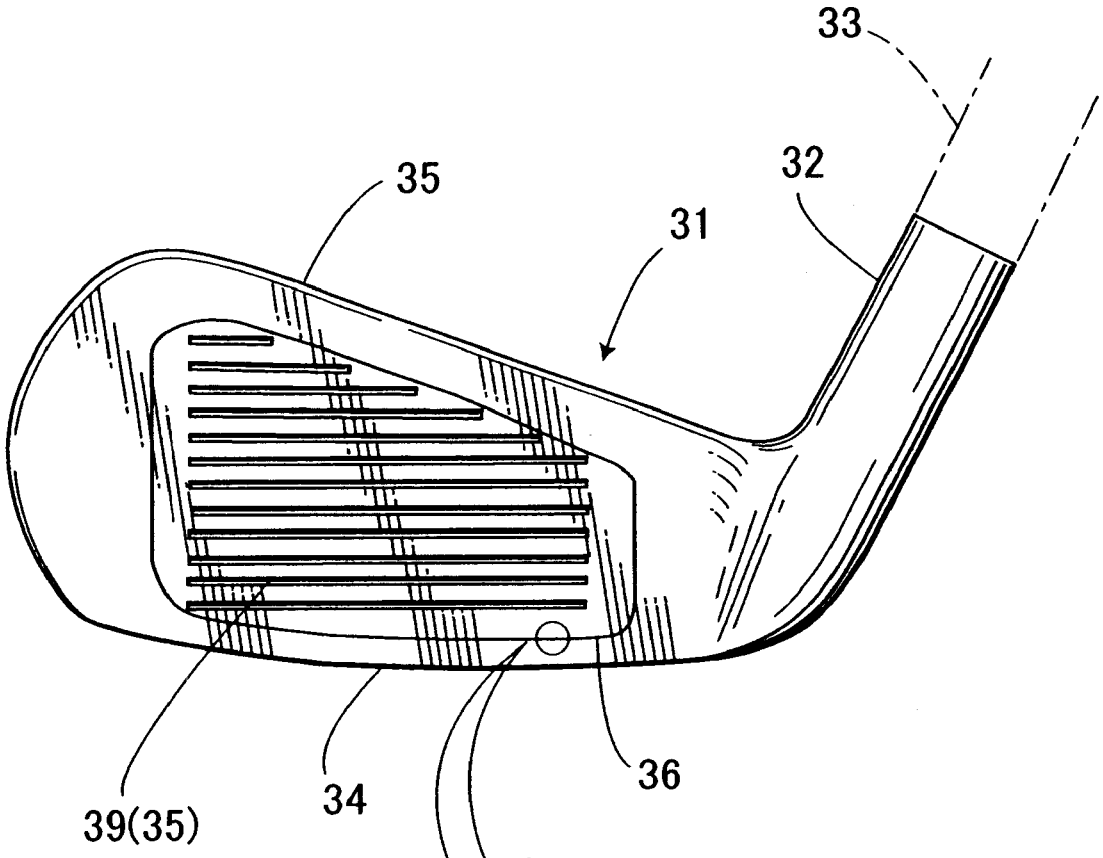
Figure 6A:
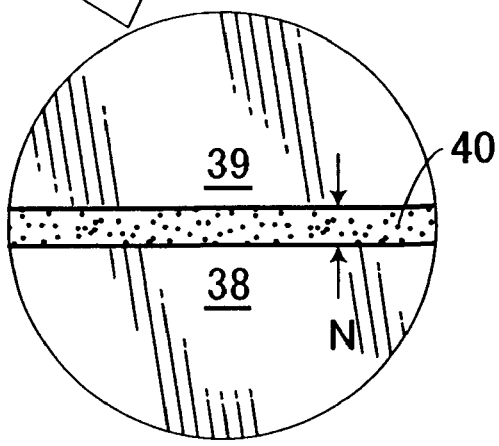
FIG. 6*a* is a partly enlarged section thereof.

In FIGS. 5 and 6 showing a third embodiment of the invention, an iron head 31 has a first side formed with a hosel 32, with a shaft 33 connected with the hosel 32. The head 31 comprises: a head body member 38, said head body member 38 including the hosel 32, a sole 34, a reverse-tapered recess 36 that corresponds to a face 35, and an aperture 37 defined through the recess 36 toward a rear; and a tabular face member 39, said face member 39 being pressed into the said recess 36.

In this third embodiment, a clearance N formed between the recess 36 and the face member 39 is filled with a mixture 40 of gluing agent and metallic powder.

According to the third embodiment of the invention, as the mixture 40 of the gluing agent and the metallic powder is filled into the clearance N, the appearance of the head is improved. Further, as the mixture 40 includes metallic powder, the mixture 40 that fills in the clearance N is also reinforced, which in turn means that the strength of the head 1 also is improved. In addition, as the gluing agent is an adhesive, the clearance N can be filled easily.

Incidentally, the present invention should not be limited to the foregoing embodiments, but may be variously modified within a scope of the invention. Although the respective shell members are made from titanium or titanium alloy in the foregoing embodiments, they may be made from iron or stainless-based metal. In that case, iron powder or stainless powder may be used as metallic powder.

What is claimed:

1. A golf club, comprising a metal head with a shaft connected thereto, said metal head being constructed by combining a plurality of members;

wherein said golf club is a metal wood golf club, comprising the metal head which is constructed by joining together a face shell member with a face formed thereon, a sole and peripheral-side shell member with a sole and peripheral side portion formed thereon, and a crown shell member, each shell member being made from either titanium or titanium alloy, and joined together by welding;

wherein said metal head further comprises a balance weight member provided inside said sole, said balance weight member being made from a denser material than that of each shell member, and having a bottom face of a lower portion thereof externally exposed through an opening defined through the sole, said bottom face being flush with the opening, while said opening has an edge rising upward to caulk the balance weight member, and wherein a mixture of gluing agent and metallic powder is filled into a clearance formed between an outer peripheral surface of the lower portion of the balance weight member and an inner peripheral surface of the edge.

2. The golf club according to claim 1, wherein said gluing agent is an adhesive.

3. The golf club according to claim 2, wherein said adhesive is acrylic or epoxy-based resin adhesive.

4. The golf club according to claim 1, wherein a particle in the metallic powder has a dimension of 20:m or below, having an identical or similar quality of that of the members to be joined.

* * * * *